US009212554B2

(12) United States Patent
Roetsch et al.

(10) Patent No.: US 9,212,554 B2
(45) Date of Patent: Dec. 15, 2015

(54) INTERCHANGEABLE HOLDER SYSTEM FOR A CHISEL

(75) Inventors: Helmut Roetsch, Beltheim (DE); Steffen Wachsmann, Koblenz (DE); Peter Erdmann, Emmelshausen (DE); Manfred Hammes, Emmelshausen (DE); Niels Laugwitz, Lahnstein (DE)

(73) Assignee: BOMAG GmbH, Boppard (DE)

( * ) Notice: Subject to any disclaimer, the term of this patent is extended or adjusted under 35 U.S.C. 154(b) by 74 days.

(21) Appl. No.: 13/884,136

(22) PCT Filed: Nov. 9, 2011

(86) PCT No.: PCT/EP2011/005618

§ 371 (c)(1),
(2), (4) Date: Aug. 5, 2013

(87) PCT Pub. No.: WO2012/062455

PCT Pub. Date: May 18, 2012

(65) Prior Publication Data

US 2013/0307316 A1 Nov. 21, 2013

(30) Foreign Application Priority Data

Nov. 11, 2010 (DE) ..... 10 2010 051 048

(51) Int. Cl.
*E01C 23/088* (2006.01)
*E01C 23/12* (2006.01)
(Continued)

(52) U.S. Cl.
CPC ..... *E21C 35/19* (2013.01); *B28D 1/188* (2013.01); *E01C 23/088* (2013.01); *E01C 23/127* (2013.01); *E21C 2035/191* (2013.01)

(58) Field of Classification Search
CPC ..... E21C 2035/191; E01C 23/127
USPC ..... 299/102, 103, 106, 107, 108, 109
See application file for complete search history.

(56) References Cited

U.S. PATENT DOCUMENTS 4,275,929 A 6/1981 Krekeler
4,621,871 A * 11/1986 Salani ..... 299/107
(Continued)

FOREIGN PATENT DOCUMENTS

AU 639773 B2 8/1993
DE 39 09 425 C1 8/1990
(Continued)

OTHER PUBLICATIONS

The International Bureau of WIPO, English Translation of the International Preliminary Report on Patentability, International Application No. PCT/EP2011/005618, mailed on May 23, 2013 (7 pages).
(Continued)

*Primary Examiner* — David Bagnell
*Assistant Examiner* — Michael Goodwin
(74) *Attorney, Agent, or Firm* — Wood, Herron & Evans, LLP

(57) ABSTRACT

The present invention relates to an interchangeable holder system comprising a basic module and an interchangeable holder for the accommodation of a cutting tool, which interchangeable holder is capable of being attached to the basic module, for the purpose of preparing ground surfaces, and to a construction machine, more particularly a stabilizer, a recycler, or a cold milling machine, comprising a milling device comprising such an interchangeable holder system.

21 Claims, 7 Drawing Sheets

(51) Int. Cl.
*E21C 35/19* (2006.01)
*B28D 1/18* (2006.01)

(56) References Cited

U.S. PATENT DOCUMENTS

| | | | | |
|---|---|---|---|---|
| 4,632,463 | A * | 12/1986 | Sterwerf, Jr. | 299/104 |
| 4,913,125 | A * | 4/1990 | Bunting et al. | 125/43 |
| 7,537,288 | B2 * | 5/2009 | Chiang | 299/102 |

FOREIGN PATENT DOCUMENTS

| | | | |
|---|---|---|---|
| EP | 1253286 | A1 * | 10/2002 |
| EP | 2 048 323 | A1 | 4/2009 |
| WO | 2006/119536 | A1 | 11/2006 |

OTHER PUBLICATIONS

ESPACENET, English Machine Translation of Application No. DE3909425C1, published on Aug. 23, 1990, retreived from http://worldwide.espacenet.com on May 7, 2013 (4 pages).

FA. Michael Komotzki, English Translation of Abstract for Application No. DE3909425C1, published on Aug. 23, 1990 (1 page).

European Patent Office, International Search Report and Written Opinion, International Application No. PCT/EP2011/005618, mailed Mar. 2, 2012 (10 pages).

European Patent Office, English Translation of International Search Report, International Application No. PCT/EP2011/005618, mailed Mar. 2, 2012 (3 pages).

* cited by examiner

Fig. 5
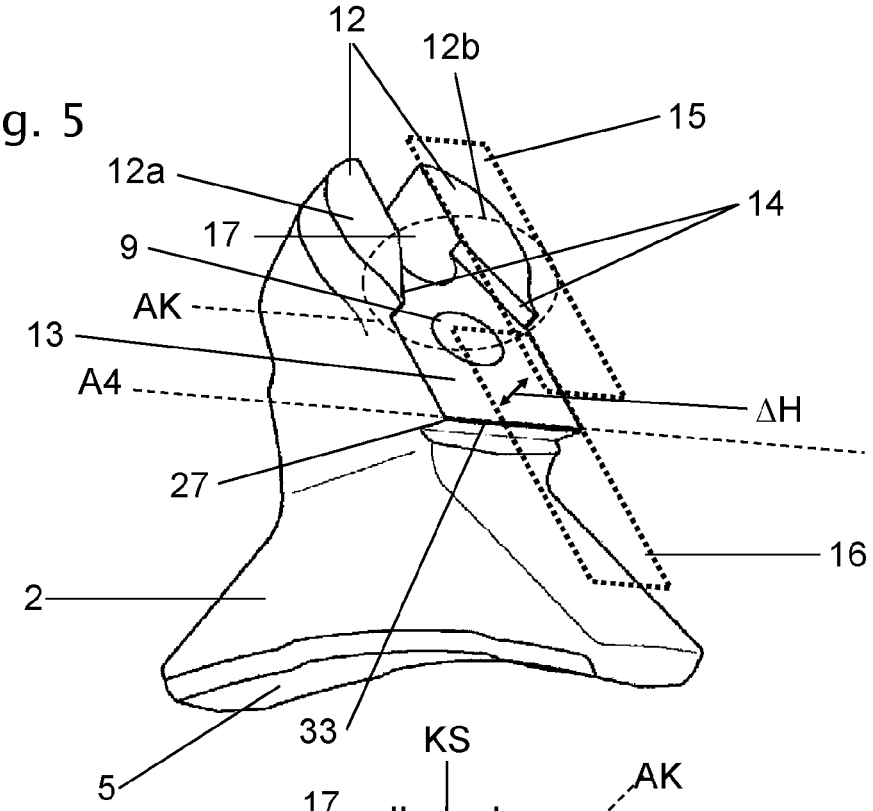
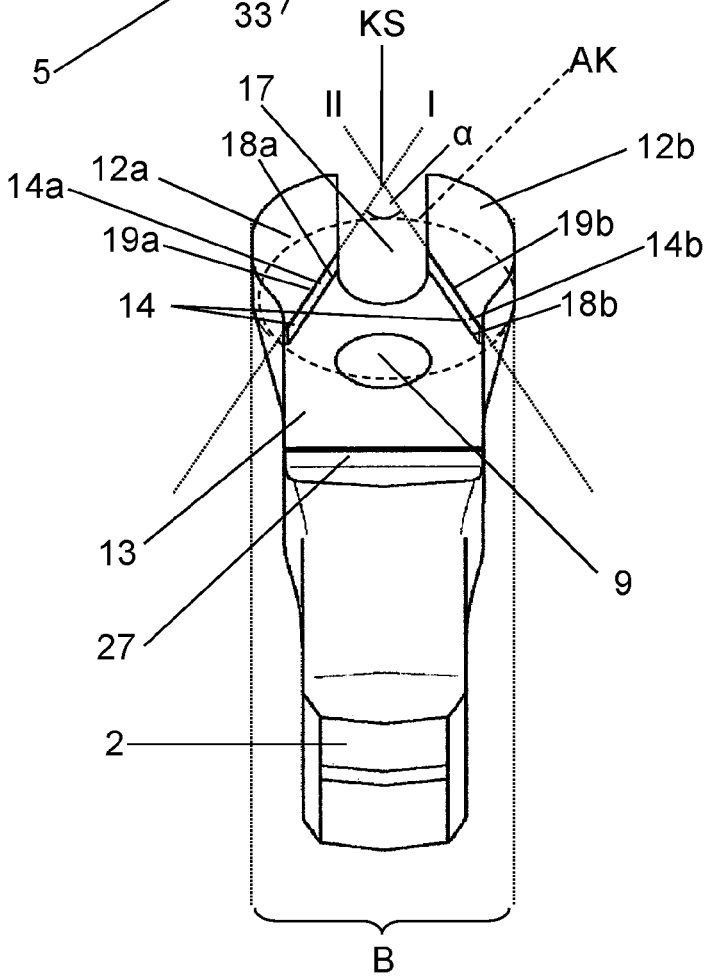
Fig. 6

INTERCHANGEABLE HOLDER SYSTEM FOR A CHISEL

CROSS-REFERENCE TO RELATED APPLICATIONS

This application is a submission under 35 U.S.C. §371 of International Application No. PCT/EP2011/005618, filed Nov. 9, 2011, which claims priority to German Application No. 10 2010 051 048.3, filed Nov. 11, 2010, the disclosures of which are hereby expressly incorporated by reference herein in their entireties.

FIELD OF THE INVENTION

The present invention relates to an interchangeable holder system and a construction machine comprising such an interchangeable holder system.

BACKGROUND OF THE INVENTION

A typical field of application for generic interchangeable holder systems is their use in machines for preparing ground surfaces, more particularly in the field of road and way construction. These are frequently machines having a driven working drum which is mounted for rotation about a horizontal axis and on which a large number of ground preparation tools, more particularly cutters or chisels and more specifically round shaft chisels, are disposed. The entire block consisting of the working drum and the large number of ground preparation tools is also referred to below as the milling rotor. Such machines include, for example, so-called stabilizers, recyclers or road cutters, more particularly cold cutters. Under working conditions, the holders containing the cutting tools are exposed to high loads and to extremely high wear, caused, on the one hand by the broken ground material in the drum housing and, on the other hand, depending on the embodiment, by the round shaft chisel rotating, for example, in the chisel holder. The wear occurs, inter alia, particularly in the region of the bore accommodating the chisel shaft in the chisel holder and in the region of the contact surface of a possibly present wearing disk. Moreover, the chisel holder is worn out or destroyed in the case of fracture, loss, or wear of the chisel. In order to make it possible to replace the worn or broken components of the chisel holder easily and quickly, the use of so-called interchangeable holder systems has become established.

The essential components of such an interchangeable holder system are a basic module and an interchangeable holder connected to the basic module and comprising a cutting tool. More specifically, the interchangeable holder may be integrally united with the cutting tool or alternatively comprise a suitable tool head, which is configured to accommodate a ground preparation tool, for example a chisel, more particularly a round shaft chisel. The basic module is rigidly attached to the cylindrical external surface of the milling drum, which is usually mounted on horizontal bearings extending at right angles to the direction of travel of an appropriate construction machine, for example by fixed welding of the basic module to the drum body. Thus the basic module is the link between the interchangeable holder system and the drum body. The basic module also serves to provide bearings for the interchangeable holder or is configured to accommodate the interchangeable holder and provide bearings therefor. Frequently, there is provided for this purpose an interchangeable holder head in the basic module, which head may be in the form of an insertion bore in the basic module, for example. The interchangeable holder may be reversibly mounted on the basic module and comprises for this purpose, for example, a suitable journal, which is pushed into the insertion bore for the purpose of mounting the interchangeable holder on the basic module. The interchangeable holder is then fixed in position on the basic module by means of a suitable securing device comprising, for example, threads, or bores for locking pins and/or screw bolts, etc. The interchangeable holder may further be at least partially conical in shape and is pushed, for mounting purposes, into an insertion bore provided in the basic module.

The cutting tool in the interchangeable holder may, on the one hand, be integrally united with the interchangeable holder, for example in the form of a cutter. On the other hand, the interchangeable holder may be configured for accommodation of an independent cutting tool and for providing bearings therefor. This is frequently the case, for example, when a chisel, especially a round shaft chisel, is used. An appropriate tool head is then provided on the interchangeable holder, for example a cylindrical chisel head in the form of a slot for round shaft chisels. Round shaft chisels are frequently mounted in the interchangeable holder for rotation about their cylinder axis and are secured against axial displacement by suitable locking means, as for example a locking sleeve.

The advantage of such an interchangeable holder system lies basically in the fact that in the case of a defective ground preparation tool and/or an interchangeable holder, it is possible to selectively replace the tool and/or the interchangeable holder without it being necessary, for this purpose, to elaborately break the fixed connection between the basic module and the drum body and then re-establish it.

Although generic interchangeable holder systems have basically proved to be successful, there is still room for improvement. For example, the known interchangeable holder systems are frequently of an extremely bulky nature, due, for example, to the method of supporting the interchangeable holder on the basic module. Particularly those embodiments in which the interchangeable holder is placed in position in an appropriate insertion bore in the basic module at least partially by means of, for example, one or more studs or the like, both the interchangeable holder and, more particularly, the basic module must be comparatively broad and heavy in order to satisfy stability requirements. On account of the massive construction, more particularly the overhanging holder width, increased power requirements must be satisfied during transportation of the material or during mixing operations. Thus, a correspondingly high driving power must be available when the machine is in action, which is inevitably accompanied by increased acquisition and operating costs. Furthermore, the separation of the interchangeable holder from the holder is frequently hampered by this system. More particularly, in a corrosive environment, such as prevails, for example, when certain binding agents are to be incorporated in the subsurface, corrosion frequently takes place to additionally bond the interchangeable holder to the holder. This is particularly problematic in the region of pin-and-socket connectors between the interchangeable holder and the holder. Moreover, the production of the hitherto known interchangeable holder systems is comparatively cost-intensive, since broad fitment tolerances exist, particularly between the basic module and the interchangeable holder, which make an extensive manufacturing process necessary. Finally, the joint between the basic module and the interchangeable holder is frequently difficult to access, so that here again there is room for improvement.

SUMMARY OF THE INVENTION

It is thus an object of the present invention to provide an interchangeable holder system which facilitates the exchange of the interchangeable holder on the basic module and at the same time increases the resistance values thereof and improves handling thereof.

The interchangeable holder system of the present invention comprises a basic module and an interchangeable holder that is equipped with a cutting tool and is capable of being attached to the basic module. The designation "equipped with a cutting tool" relates, on the one hand, to those embodiments in which the cutting tool is integrally united with the interchangeable holder and, on the other hand, to those embodiments in which the cutting tool is held by the interchangeable holder as a discrete part. The latter comprises both embodiments in which the cutting tool is rigidly connected to the interchangeable holder and variants in which the cutting tool is configured so as to replaceably mounted in the interchangeable holder, more particularly as a round shaft chisel. The basic module comprises a forward contact surface and a rearward contact surface situated below the level of the forward contact surface. The terms "forward" and "rearward" relate more particularly to a longitudinal axis of the cutting tool, oriented in the machine direction of the cutting tool. In the case of a round shaft chisel, the longitudinal axis of the cutting tool is thus the shaft axis extending from the rearward end of the chisel towards the tip of the chisel. The longitudinal axis of the cutting tool extends in general with reference to a plane at right angles to the rotation axis of the milling rotor generally in the region between a radial plane extending through the rotation axis "a" of a milling rotor equipped with the interchangeable holder system of the present invention and the direction of action of the force applied by the ground material to be prepared and acting tangentially at the cutting periphery of the milling rotor on the tip of the cutting tool. The terms "forward" and "rearward" are to be understood, in particular, in terms of the mounting direction of the interchangeable holder on the basic module, the forward contact surface on the basic module being at a higher level than the rearward contact surface. The two contact surfaces are separated from each other by a stopping step in the form of a stop wedge. The stop wedge in the present instance consists more particularly of two contact surfaces set at an angle to each other so as to approach each other, these being of a protruding or receding configuration with regard to the adjacent surface. The pointing direction of the wedge is that direction in which the distance between the contact surfaces diminishes. The interchangeable holder is configured for at least partial contact with the basic module at the forward contact surface and at the rearward contact surface across the stopping step. The interchangeable holder system of the present invention finally comprises a securing device, by means of which the interchangeable holder bearing on the basic module can be fixed in position on the basic module.

A fundamental aspect of the present invention resides first in the fact that the interchangeable holder no longer needs to be pushed into the basic module in order to attach it to the basic module, for example by means of a journal or by way of its base body inserted into an appropriate reception hole, but rather can be attached flat against the basic module. For this purpose there are present on the basic module the said forward contact surface and the said rearward contact surface, both of which simultaneously serve as a contact surface or a bearing surface for the interchangeable holder on the basic module. The terms "forward" and "rearward" refer to a reference perpendicular standing vertically on one of the two surfaces, the "rearward" contact surface being at a receded level relative to the "forward" contact surface, at least in the region of the stopping step, as viewed along this reference perpendicular. As regarded in the machine direction (i.e., that direction in which the cutting tool is moved by the rotating milling rotor during the milling operation), the forward contact surface is at least partially, and more particularly completely, in advance of the rearward contact surface. The forward contact surface and the rearward contact surface are thus two surfaces, whose levels relative to each other are offset in the machine direction of the interchangeable holder system disposed on a milling rotor, said offset from each other being formed by the stopping step, that is to say, taken as a whole, a step is formed between them. The "forward" contact surface is that surface which at least in the region of the stopping step is at a higher level along the machine direction and the "rearward" contact surface is correspondingly that surface which at a receded level relative to the forward contact surface along the machine direction at least in the region of the stopping step, that is, in the transition region between the forward contact surface and the rearward contact surface, more particularly as regarded in the axial direction of the cutting tool. The machine direction of the interchangeable holder system is that direction in which it is moved by a milling rotor during the milling operation. Said movement is usually a movement of rotation, that is to say, the machine direction is in each case a tangential directional vector. If, for example, a round shaft chisel is used as cutting tool, the machine direction is typically inclined relatively to the axial direction of the round shaft chisel or the round shaft chisel head in the interchangeable holder as a tangent starting from the tip of the chisel and directed in the direction of rotation to the cutting periphery of the milling rotor.

The forward contact surface and the rearward contact surface are relevant to the stopping step extending between said two contact surfaces. The stopping step is such that element which connects the forward contact surface to the rearward contact surface. The stopping step comprises a top edge extending in the longitudinal direction and merging into the forward contact surface, and a bottom edge extending in the longitudinal direction and merging into the rearward contact surface. Between these two edges there is usually present a wall in the form of a step, which is preferably in the form of a flat plane at least in certain regions thereof or is segmented to form a plurality of flat plane elements. However, it is of course also possible to design the wall in the form of a step in the longitudinal direction of the top edge and/or the bottom edge as a curved element, for example so as to be convex or concave or wavy, etc. Furthermore, the wall in the form of a step or stopping step is tilted or inclined relatively to the forward contact surface and/or the rearward contact surface, an arrangement in which the wall in the form of a step is perpendicular to the adjacent forward contact surface and/or the adjacent rearward contact surface in each case, or an arrangement in which the said wall at least partially represents an undercut relatively to the forward contact surface, i.e., is at an angle to the forward contact surface of less than 90°, has proved to be preferable.

In practical usage, it is important in a generic interchangeable holder system that the correct alignment of the interchangeable holder relative to the basic module be reliably ensured during assembly. Another important factor is that the position of the interchangeable holder should remain perfectly stable in spite of the considerable forces that act on the interchangeable holder system under working conditions, in order to ensure flawless functioning of an appropriately equipped milling rotor. The term "working conditions" means the practical employment of the interchangeable holder system in carrying out milling operations, usually with a milling rotor. According to one embodiment of the present invention, this is achieved, on the one hand, by the specific design of the counter contact surface on the interchangeable holder for achieving contact with the forward contact surface and the rearward contact surface across the stopping step and, on the other hand, by the design of the stopping step as a stop wedge and by the presence of a securing device.

Thus the interchangeable holder firstly comprises counter contact surfaces, which are provided for the purpose of making contact with, or of bearing flat against, the forward contact surface and the rearward contact surface on the basic module. Once the interchangeable holder has been mounted on the basic module, the interchangeable holder will bear, with a first contact surface, against the forward contact surface of the basic module and, with a second contact surface, against the rearward contact surface of the basic module. In other words, the interchangeable holder thus likewise comprises a forward contact surface (i.e., a contact surface that protrudes towards the basic module) and a rearward contact surface situated at a receded level relative to its forward contact surface (in the direction towards the interchangeable holder), which contact surfaces are separated from each other at different levels by a step, such that the interchangeable holder can bear flat against the forward contact surface and the rearward contact surface on the basic module when mounted on the basic module. In the mounted state, the forward contact surface (i.e., that protruding towards the basic module) of the interchangeable holder bears against the rearward contact surface of the basic module and vice versa. Due to the fact that the interchangeable holder is thus configured to bear against the basic module across the stopping step in the form of a stop wedge, there results, firstly, a type of anti-twist stop on the basic module with respect to the interchangeable holder. On account of the stopping step present in the region of contact between the interchangeable holder and the basic module, the interchangeable holder cannot be freely rotated with respect to the basic module in a plane parallel to the rearward or forward contact surfaces, but is hindered from doing so by the stopping step. The stopping step present in the basic module and bridged by the interchangeable holder in the stopping region or contact area between the basic module and the interchangeable holder thus contributes substantially to the positional stabilization of the interchangeable holder on the basic module. In other respects, the region of contact between the two contact surfaces and the stopping step between the basic module and the interchangeable holder is free from protruding elements, such as slide-in elements, for example journals, a bearing cone, etc., and is thus in its overall design completely flat such that the interchangeable holder need not be partially pushed into an insertion bore in the basic module, but can be mounted flat thereon.

Another contribution to the mounting of the interchangeable holder on the basic module is afforded by the wedge-shaped design of the stopping step on the basic module and the appropriate mating surface on the interchangeable holder. In addition, the interchangeable holder is provided with a stopping step in the form of a stop wedge which comes to bear against the stopping step in the basic module. Thus the stopping step in the form of a stop edge on the basic module is wedge-like engaged by a counter region of the interchangeable holder, which counter region is likewise in the form of a stop wedge and comes to bear against this region. In this way, any shift of the interchangeable holder in the pointing direction of the wedge, that is, in the direction in which the tip of the wedge points in each case, is totally excluded. The stop wedge on the basic module (and respectively also on the mating surface of the interchangeable holder) is characterized, firstly, in that it has a wedge-shaped profile in the plane of the forward contact surface and/or the rearward contact surface. Thus the connecting region between the forward contact surface and the rearward contact surface is, for example, substantially V-shaped or C-shaped or has at least two wedge flanks that approach one another. The wedge flanks of the stop wedge or the two side walls of the stop wedge are in other words disposed relatively to each other, in such a manner that the distance separating each other increases in one direction (in the direction pointing away from the tip of the wedge). The stop wedge for this purpose may, for example, be rounded off or curved so as to obtain, for example, a convex or concave profile. However, it has proved to be very advantageous to use the design of the stop wedge comprising planar and linear flanks. The term "flank" designates in each case a continuously extending, more particularly at least substantially plane, wedge-shaped surface or wall of the stop wedge formed by the stopping step. Planar and linear flanks are considerably more suitable for the purpose of counteracting rotation of the interchangeable holder relatively to the holder or basic module in the following manner described in detail by way of example and for the purpose of establishing a positive interlock. At least the top edge and/or the bottom edge thus preferably comprises two flank segments, which in the plane of the corresponding forward contact surface and/or rearward contact surface are configured or arranged such that they approach one another. There, may, of course, be present a plurality of wedge segments disposed side-by-side such that the stopping step comprises an overall serrated profile, for example. The segments are preferably identical as regards their step height and their respective edge length. However, the edges of the two segments extend in different directions in space and the distance between them increases in the direction contrary to the pointing direction of the wedge, such that they form, say, a "V" or "C" relatively to each other in the plane of the forward contact surface and/or in the plane of the rearward contact surface. The stop wedge may be further configured in such a manner that the wedge flanks directly intersect in the region of the tip of the stop wedge. Alternatively, however, an opening may be present in the region of the tip of the stop wedge, so that the extensions of the longitudinal edges of the wedge flanks intersect at the tip of the wedge. Thus the two segments form, in other words, a contact wedge on the basic module, which contact wedge is preferably configured so as to positively accommodate a corresponding counter wedge on the interchangeable holder. This arrangement makes it possible to achieve a particularly efficient anti-twist stop on the interchangeable holder relative to the basic module. To this end, the contact wedge on the basic module may be configured to protrude from the basic module in the direction of the interchangeable holder to ng age in an appropriate recess in the wedge on the interchangeable holder. However, it preferable to provide a wedge-like protrusion on the interchangeable holder and to provide the requisite opening in the basic module for the purpose of accommodating, or bearing against, the wedge-like protrusion. Both the wedge-like protrusion and the opening in the wedge are included in the term "stop wedge". The wedge-like protrusion and the opening in the wedge are further configured relatively to each other in such a manner that the forces acting on the interchangeable holder when the cutting tool is subjected to a work load are directed at least partially against the stopping step in the basic holder such that the interchangeable holder is, for example, "pressed" into the stopping step under working conditions. This is particularly successful due to the fact that the forward contact surface of the basic module extends, with respect to the bottom region of the basic module (the connecting region for the cylindrical drum of the milling rotor), at least in the region of the stopping step, at least partially above the rearward contact surface and thus forms a hindrance to displacement caused by the transverse force acting on the interchangeable holder, that is to say, forms a cross force absorber.

Finally, another element of the interchangeable holder system of the present invention is the provision of a securing device. The securing device serves the purpose of fixing or holding the interchangeable holder in position on the basic module after it has been placed flat on the basic module or mounted thereon. Such securing devices are known per se in the prior art and may, for example, be based on suitable screwing methods, bracing methods, bolting methods, etc. Basically, it is possible to resort to prior methods known to the person skilled in the art for the purpose of achieving the securing device for locking the basic module to the interchangeable holder. However, it is ideal when the securing device comprises at least one mounting screw that can be used for the purpose of fixing the interchangeable holder to the basic module. For this purpose, such a locating screw is guided, for example, through an appropriate through bore extending through the basic module such that it meets the interchangeable holder, in which a corresponding female thread is present. The integration of the female thread in the interchangeable holder has the further advantage that, when the interchangeable holder is replaced, not only is the interchangeable holder but also the female thread renewed and thus a reliable and heavy-duty engagement of the locating screw is ensured. According to one embodiment, the design of the securing device of the present invention stabilizes the installation of the interchangeable holder on the basic module in the manner described above. The design of the stopping step as a stop wedge as proposed by the present invention makes it possible, in a preferred embodiment, to also relieve the securing device from transverse forces and thrust forces occurring between the interchangeable holder and the basic module, since these forces are transferred between the two components substantially via the wedge-shaped stopping step. Preferably, the securing device is further configured in such a manner that it is inclined relatively to the forward contact surface and to the rearward contact surface on the basic module such that when the securing device is tightened, the interchangeable holder with its region of contact is drawn into the thrust wedge on the basic module, particularly when this is undercut. This arrangement, in conjunction with the flat region of contact between the interchangeable holder and the basic module, has the further advantage that dismantling is facilitated. First of all, the securing device can be more easily released, since it is subjected to less load on account of the wedge-shaped design of the stopping step. At the same time, the interchangeable holder can then be readily released from the basic module, even if the interchangeable holder adheres to the basic module on account of corrosion. If desired, any adhesion forces present may then be overcome, for example, by means of hammer blows applied to the interchangeable holder in the direction contrary to that in which the wedge of the stopping step points.

In all, the interchangeable holder system of the present invention thus makes it possible to place the interchangeable holder on the basic module without it being necessary for the basic module to accommodate or receive, for this purpose, a (plug-in) part of the interchangeable holder in a bearing-type bore in the basic module (or vice versa). Rather, there exists between the basic module and the interchangeable holder an exclusively stepped flat region of contact in the surface, which in each case extends to the edge of the basic holder and the interchangeable holder and ensures secure seating of the interchangeable holder on the basic module. The interchangeable holder system can therefore be substantially narrower than the known interchangeable holder systems, as a result of which there is a considerable saving of material and weight. At the same time, the disassembly of the interchangeable holder is particularly facilitated, since this can be achieved simply by knocking the interchangeable holder out of the wedge-shaped stopping step. Moreover, there is no need to carry out the usually cost-intensive and time-consuming production of elaborate and extensive of regions involving fitting tolerances between the interchangeable holder and the basic module, since the contacting structures consisting of the "forward" and "rearward" contact surfaces in the basic module (and, as mentioned above, in the interchangeable holder), as proposed by the present invention, can be achieved in a comparatively simple manner.

It is basically possible for the interchangeable holder to only partially bear against the forward contact surface and the rearward contact surface on the basic module and for the stopping step to contact only certain regions or certain spots thereon. In view of the facilitated assembly and, in particular, of the secure positioning of the interchangeable holder on the basic module, it is, however, preferred that the interchangeable holder, for the purpose of achieving a flat contact across the entire basic module, be configured so as to complement the forward contact surface, the rearward contact surface and the stopping step of the basic module such that it bears flush against the forward contact surface and the rearward contact surface and against the stopping step across the entire contact surface. The interchangeable holder is thus positively configured with respect to the basic module in the region of contact. On the basic module, substantially the entire region consisting of the forward contact surface, the rearward contact surface, and the stopping step is thus formed as a common continuous region of contact, via which the interchangeable holder bears against the basic module as a continuous entity and preferably exclusively in the mounted state on the basic module. Thus in other words, the interchangeable holder is in its region of contact configured as the negative of the region of contact on the basic module. This relates, however, only to the design of the contact surfaces and ignores, for example, the presence of maintenance holes and reception holes for tools adapted to prepare ground surfaces, etc. Essential to this embodiment is the fact that the basic module and the interchangeable holder can be placed together in the region of the forward and rearward regions of contact and in the region of the stopping step substantially with no gap formed therebetween in the mounted state, on account of the mutually positively configured regions of contact.

And more particularly, from the manufacturing point of view, it is advantageous when the forward contact surface and the rearward contact surface of the basic module (and accordingly also those of the interchangeable holder) are in each case perfectly plane. Thus each of the contact surfaces lies, in these embodiments, in a plane and are not curved, serrated, wavy, or otherwise three-dimensionally shaped, although this is basically possible but not preferred. Furthermore, the plane of the forward contact surface and/or of the rearward contact surface is preferably configured in the interchangeable holder system in such a manner that it is cut so as to be inclined to the direction of force absorption of the ground preparation tool. The direction of force absorption of the ground preparation tool is the direction in which the force exerted by the surface to be prepared acts, under working conditions, against the ground preparation tool. When a round shaft chisel is used, the said direction is usually the direction of the force acting tangentially against the tip of the chisel at the cutting periphery of the rotating milling rotor contrary to the direction of rotation of the milling rotor. Thus the direction of force absorption is contrary to the machine direction.

It is further possible for the forward contact surface and the rearward contact surface to be at an angle to each other so as to intersect when appropriately extended. However, it is preferred that the plane in which the forward contact surface lies be parallel to the plane in which the rearward contact surface lies. This facilitates the fabrication of the interchangeable holder system of the present invention. Moreover, it is possible, in this embodiment, for both the forward contact surface and the rearward contact surface to be disposed obliquely to the direction of force absorption, in order to obtain ideal force transmission results and thus an interchangeable holder system with particularly satisfactory load-bearing properties.

The stopping step is, as mentioned above, the coupling element between the forward contact surface and the rearward contact surface in the basic module. Preferred design options for the stopping step are revealed, within the scope of the present invention, for example, in the design of the stopping step in the transition region to the forward contact surface and/or in the transition region to the rearward contact surface. Thus it is possible, for example, to provide the stopping step with a rounded shape in a plane at right angles to the longitudinal extent of the stopping step. For this purpose, the edge region or marginal region between the stopping step and the forward contact surface and/or the rearward contact surface may, for example, be rounded. However, in order to obtain ideal positional stabilization and power transmission between the basic module and the interchangeable holder, the edge is preferably tapered or beveled. Thus two straight lines of the respective portions of the surface meet towards the respective edge in the plane at right angles to the longitudinal extent of the edge. It is preferred that these lines be at right angles to each other or form an acute angle.

Another design option for the stopping step resides in their specific arrangement on the basic module. For example, the wedged shape of the stopping step may be in the form of a continuous element having two wedge flanks or stop limit surfaces that converge in the region of the tip of the wedge. In practical usage of the interchangeable holder system of the present invention, it has been found, however, to be advantageous to provide the stopping step in segmented form. The term "segmented" should be understood, in particular, to mean that the stopping step does not extend continuously across its entire area between the forward and rearward regions of contact, but comprises at least two segments. The segmentation may be based on different angular positions of the flanks of the stop wedge with respect to the forward contact surface and the rearward contact surface, on the one hand, and/or on different lengths of each flank. Furthermore, at least one flank of the stopping step in the form of a stop wedge may be interrupted, for example, by a bore. Finally, for example, the region of the tip between the two flanks, i.e., the region in which the two flanks of the stop wedge meet in the pointing direction of the wedge, may comprise an opening. Thus, in this embodiment, the stopping step in the form of a stop wedge comprises two contact surfaces that are spaced at an angle to each other. It is essential for the design of the stopping step in wedge form that it should comprise at least two wedge-shaped surfaces, against which the interchangeable holder with its corresponding wedge-shaped counter region can hit in addition to the forward contact surface and the rearward contact surface, so that displacement thereof in the pointing direction of the wedge (the direction in which the tip of the wedge points) is hindered.

Even though the angular position of the two legs or flanks of the stop wedge can be basically varied over a broad range, the longitudinal edges of the two segments of the stop wedge are preferably at an angle to each other ranging from 120° to 30°, more particularly from 100° to 50°, and very particularly from 80° to 60°. It is not necessary, as already stated above, for the two wedge flanks or legs to be directly adjacent to each other. The angles stated above apply likewise to legs that are spaced apart from each other. The appropriate angles formed by the legs are then determined by the extensions of the legs along their longitudinal edges.

In order to obtain as uniform an anti-twist stop as possible in both directions of rotation of the interchangeable holder with respect to the basic module, the stopping step in the form of a stop wedge is preferably configured mirror-symmetrically on the basic module. The flanks of the stop wedge are therefore preferably configured in the same manner. The same applies to the segmented form of the stopping step. The at least two segments are thus likewise preferably configured in the same manner and are ideally mirror-symmetrical to each other.

Furthermore, the stopping step may vary in the manner stated above alternatively or additionally to the above preferred developments regarding the arrangement of the wall in the form of a step or the flanks of the stop wedge of the stopping step relative to the forward contact surface and/or the rearward contact surface. In addition to the course of the respective edge relative to the forward contact surface or to the rearward contact surface in the respective plane of the contact surfaces, the cross-sectional profile of the stopping step, that is to say, the design of the stopping step in a plane at right angles to the wall in the form of a step, may be differently configured. On the one hand, is it again possible to shape the wall in the form of a step adjoining the upper contact surface and/or the receded contact surface so as to be rounded, while basically preference is given to an angular design, as stated above. Regarding the respective angle between the wall in the form of a step and the forward contact surface or the rearward contact surface, optimum results have been obtained using in each case a right-angled or perpendicular arrangement, since such an arrangement is favorable for fabrication and at the same time produces, in the mounted state, reliable results regarding the positional stability of the interchangeable holder with respect to the basic module. Alternatively, however, it is possible to configure the wall in the form of a step such that it is tilted or inclined with respect to the forward contact surface and/or to the rearward contact surface, more particularly in such a way that the forward contact surface protrudes above the rearward contact surface in the region of the stopping step or forms a type of overhang (which will, in the mounted state, be rearwardly engaged by the interchangeable holder ideally configured so as to have a suitably complementary shape). In this way, the profile of the stopping step in the vertical cross-sectional plane likewise affords a type of retaining wedge, with the result that this interchangeable holder system is capable of carrying an even greater load.

It will be appreciated that, according to the present invention, all of the design alternatives for the basic module relating to the forward contact surface and the rearward contact surface and to the stopping step also apply to the design of the region of contact on the interchangeable holder, preferably as regards the complementary configuration of the contact surfaces and the stopping step. For the sake of clarification, it is not intended to repeat all of the embodiment variants for the interchangeable holder.

In a particularly preferred embodiment of the present invention, the interchangeable holder system is further provided with a relieving device between the interchangeable holder and the basic module, which relieving device is configured in such a manner that, when the interchangeable holder system is heavily loaded, for example by the occurrence of increased thrust forces on the cutting tool, it will provide for additional force absorption from the interchangeable holder into the basic module. More specifically, the basic module may for this purpose comprise, for example, a supporting projection and the interchangeable holder a relief ledge. It is essential for this embodiment that the basic module comprises a supporting projection in addition to the wedge-shaped stopping step of the present invention. The supporting projection is configured in such a manner that the interchangeable holder, when subjected to a heavy load, i.e., more particularly, when it starts to show slight deformation, can be additionally supported by said supporting projection. More particularly, any thrust forces acting on the interchangeable holder can be absorbed in this way in a very satisfactory manner and transferred to the basic module, with the result that the overall load-bearing capacity of the interchangeable holder system can be enhanced. For this purpose, the supporting projection is, for example, in the form of a projection that can be at least partially surroundingly or rearwardly engaged by the interchangeable holder. The interchangeable holder may for this purpose comprise, for example, a suitable relief ledge in the form of a hook-like projection provided on the interchangeable holder and configured such that it can at least partially surroundingly engage the supporting projection. The supporting projection and the relief ledge can be basically designed in such a manner that they bear against each other in the mounted state of the interchangeable holder on the basic module such that force transmission from the relief ledge to the supporting projection can take place even under small loads. It is preferred, however, that in the mounted state the relief ledge and the supporting projection be separated from each other by a small gap. When the interchangeable holder is now subjected to an excessive load to the point at which partial deformation of the interchangeable holder takes place, this gap will be closed as a result of the deformation and the relief ledge will come to bear, ideally flatly, against the supporting projection. From this moment on, continued loading will cause an additional partial force absorption to occur via the supporting projection of the basic module, such that the interchangeable holder is totally relieved. Thus the relief ledge and the supporting projection in the interchangeable holder system are again preferably designed in such a way that the counter-force caused to act under working conditions on the interchangeable holder system by the ground being prepared presses the relief ledge against the supporting projection. As regards the stopping step in the form of a stop wedge, this means that the supporting projection is preferably disposed upstream of the stop wedge, as regarded in the direction of thrust, i.e., in the direction in which, under working conditions, typically thrust forces are exerted on the interchangeable holder system. Furthermore, the stop wedge preferably points in the direction in which the thrust forces act on the interchangeable holder system. In this way, forces acting on the interchangeable holder will be absorbed by the basic module in an optimal manner.

The supporting projection and the relief ledge may vary in design, but it is preferred that, at least in the loaded condition, there is basically a positive engagement of the relief ledge on the supporting projection across the entire region of contact between these two elements. Thus the region of contact on the relief ledge is ideally designed so as to be complementary to the region of contact of the supporting projection. For this purpose, both the relief ledge and the supporting projection are configured, for example, such that each is flat and ideally extends at right angles to the machine direction of the interchangeable holder system. However, in addition to plane embodiments, curved variants are also possible. It is however more particularly possible to configure the respective stopping regions on the supporting projection and on the basic module, such that they are segmented, as stated above for the stop wedge, and, more particularly, are likewise wedge-shaped, and it is here again self-evident that in addition to embodiments comprising linear or planar segments use may also be made of curved or mirrored convex or concave segments. It is of very great advantage in this respect when the wedge of the wedge-shaped stopping region between the supporting projection and the base ledge points in the direction of the stop wedge between the forward contact surface and the rearward contact surface and ideally in the same direction as this stop wedge. It is also preferred that the supporting projection, as regarded in the cross-section of the interchangeable holder system, be configured so as to extend from the marginal area of the receded contact surface of the basic module, more particularly approximately in the machine direction of the cutting tool, to form a rearwardly directed hook-like element and thus, in particular, does not protrude above the receded contact surface.

The basic module and/or the interchangeable holder are also preferably formed as forged or cast parts.

Moreover, a material-guiding region is preferably present on the basic module and/or on the interchangeable holder in the region directed in the machine direction, which material-guiding region serves as an improved guiding means for the milled material and/or the material to be mixed and as a wear pad. More specifically this can be, for example, one or preferably two wedge-shaped surfaces downwardly sloping to the sides of the basic module or interchangeable holder, which sloping surfaces are ideally center-symmetrical to each other. This region is also preferably domed away from the basic module to form a boss, and it is basically also possible to provide a boss-like design not comprising appropriate wedge-shaped surfaces. This boss contributes to the formation of a region of wear or a wear pad on the interchangeable holder that enables a considerable extension of the operating life of the interchangeable holder to be achieved. Furthermore, the boss preferably extends in the machine direction of the interchangeable holder system and may additionally overlap a portion of the basic module on at least one side of the region of contact between the interchangeable holder and the basic module in order to protect the basic module more efficiently from wear.

During operation, is it frequently necessary for the region of the cutting tool to be accessible from the rear, as regarded in the machine direction of the interchangeable holder system. This is the case, for example, when a cutting tool held in the interchangeable holder, for example a round shaft chisel, is to be selectively replaced without dismantling the interchangeable holder from the basic module. To this end, the interchangeable holder is frequently provided with an access opening, through which the rear part the cutting tool accommodated by the interchangeable holder is accessible. This may be necessary, for example, for the purpose of ejecting the cutting tool from the interchangeable holder. More specifically, it might be the end of a chisel shaft, for example. According to the present invention, provision is therefore made, in a preferred embodiment, for an opening to be present in the basic module, which is configured in such a manner that it allows access from the outside of the interchangeable holder system to the cutting tool, more particularly to the rear end of the cutting tool, in the interchangeable holder. Although it is basically also possible to provide a suitable opening in the interchangeable holder itself, it is better, for stability reasons, to make the interchangeable holder as massive as possible in the region of the respective holding means for a cutting tool, for example for a substantially hollow cylindrically shaped holder for a round shaft chisel, and to configure the holder so as to surroundingly accommodate the tool. In order, nevertheless, to provide access to the rear end of the cutting tool, it is therefore preferable to provide suitable means of access in the basic module. It is particularly favorable when the opening in the basic module merges into the forward region of contact and/or the rearward region of contact or is, in other words, a partial cut-out in the forward and/or rearward regions of contact. With regard to the basic module, the opening is in this case therefore a notch, more particularly a notch that is open towards the rear end of the interchangeable holder system, and is not a hole-like opening, which arrangement, in particular, considerably facilitates the production flow. Moreover, cleaning of the recess is facilitated. Alternatively or additionally, it is preferable when the cutting tool is held alone by the interchangeable holder. Mounting of a round shaft chisel thus takes place, in this embodiment, exclusively on the interchangeable holder and not additionally on the basic module. This simplifies the design of the basic module.

Another aspect of the present invention relates to the provision of a construction machine for the preparation of ground surfaces, more particularly to a cold milling machine, stabilizer or recycler, comprising a milling rotor, on which there is disposed at least one interchangeable holder system as defined in any one of the previous claims. The interchangeable holder system of the present invention enables, in particular, the resistance to transportation and mixing to be reduced. This means that equal operation results can be achieved at lower driving power requirements, which makes it possible to use driving units that have lower drive requirements and are thus less expensive in terms of acquisition and operating costs, or to increase the performance for a given driving power. It will also be appreciated that the present invention also extends to a basic module and an interchangeable holder as such and to their use in an interchangeable holder system having the above features.

BRIEF DESCRIPTION OF THE DRAWINGS

The present invention is explained in greater detail below with reference to two exemplary embodiments. In the drawings:

FIG. 5 is a perspective oblique view of the basic module as shown in FIGS. 1 to 4, as viewed obliquely from the front;

FIG. 6 is a perspective forward view of the basic module as shown in FIG. 5;

DETAILED DESCRIPTION OF THE INVENTION

Identically constructed components or components of identical function are designated in the following figures by identical reference signs.

Figure 1:
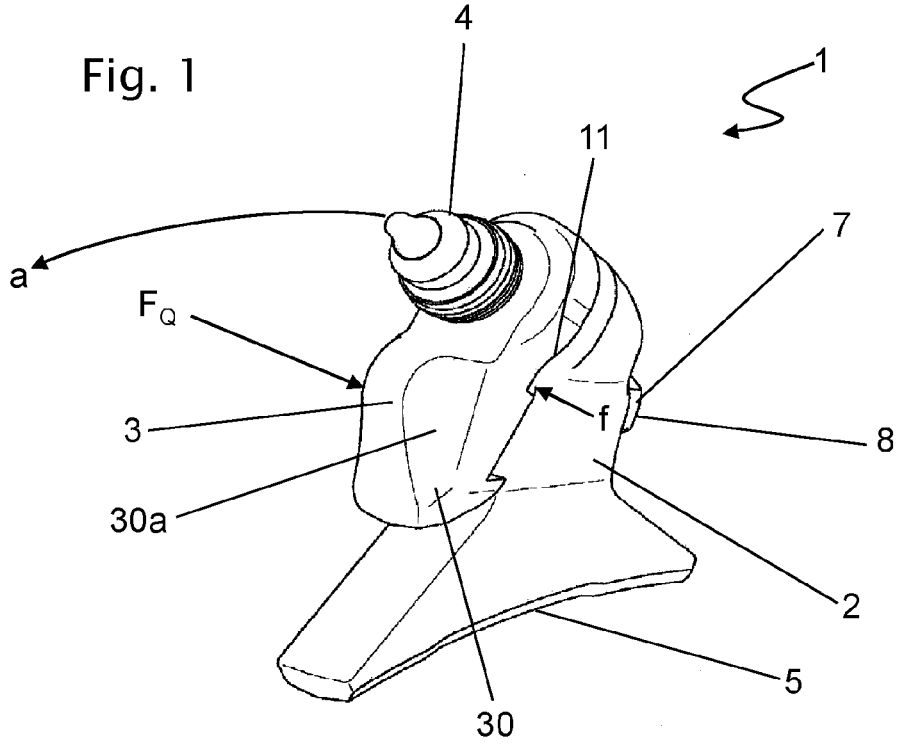
FIG. 1 is a perspective oblique view of an interchangeable holder system according to one embodiment as viewed obliquely from the front.
Figure 2:
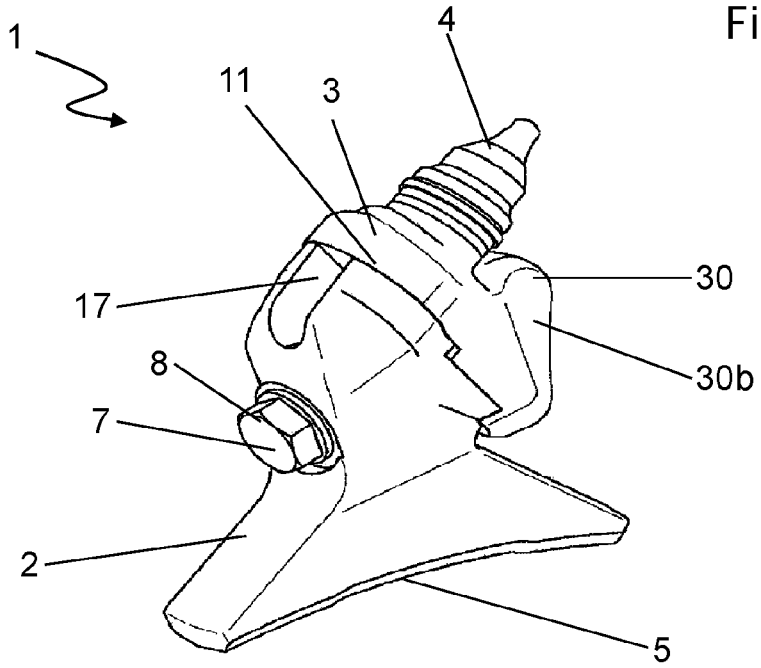
FIG. 2 is a perspective oblique view of the interchangeable holder system shown in FIG. 1, as viewed obliquely from the rear.
Figure 3:
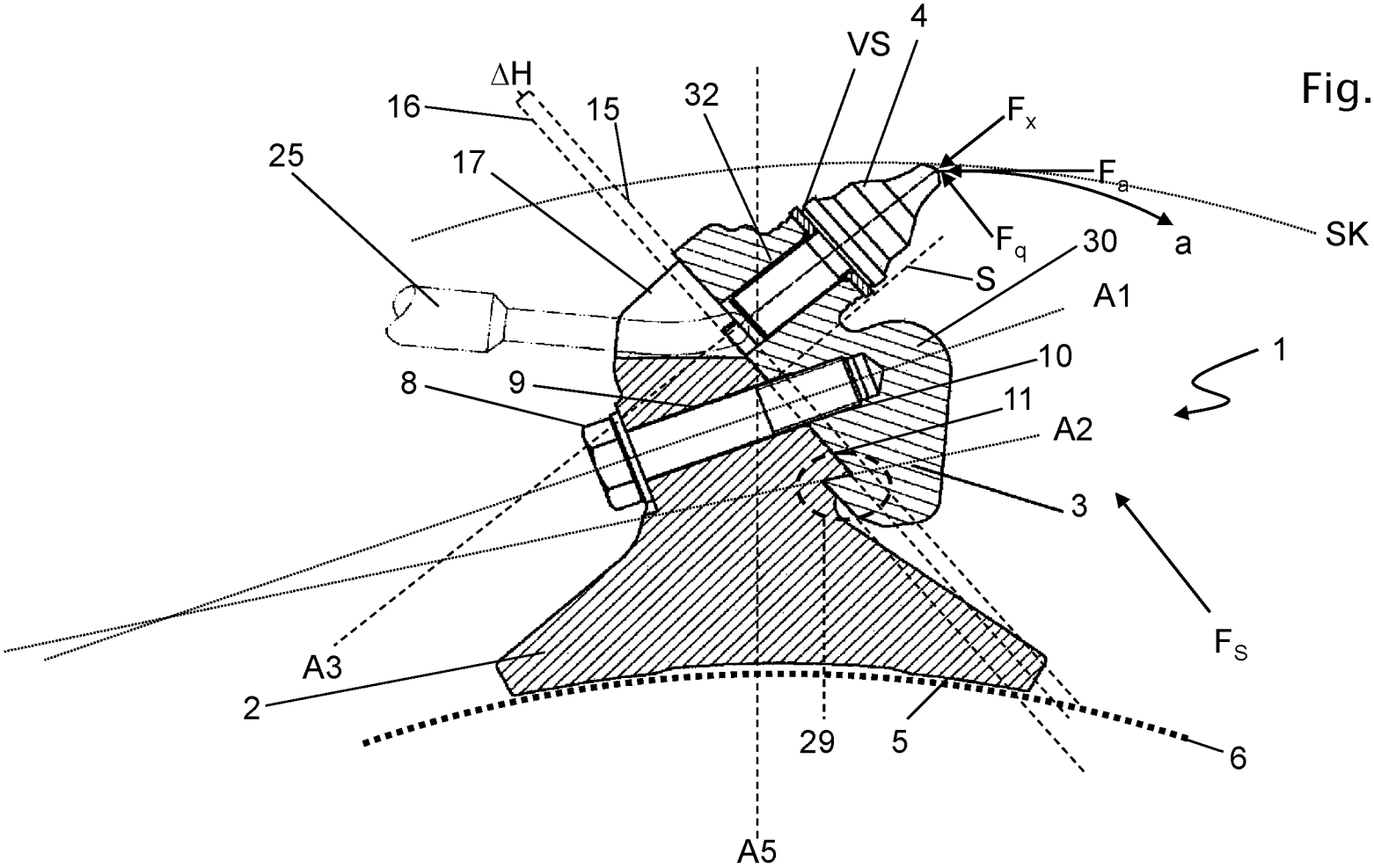
FIG. 3 is a longitudinal cross-section taken in the machine direction through the interchangeable holder system as shown in FIGS. 1 and 2.
Figure 4:
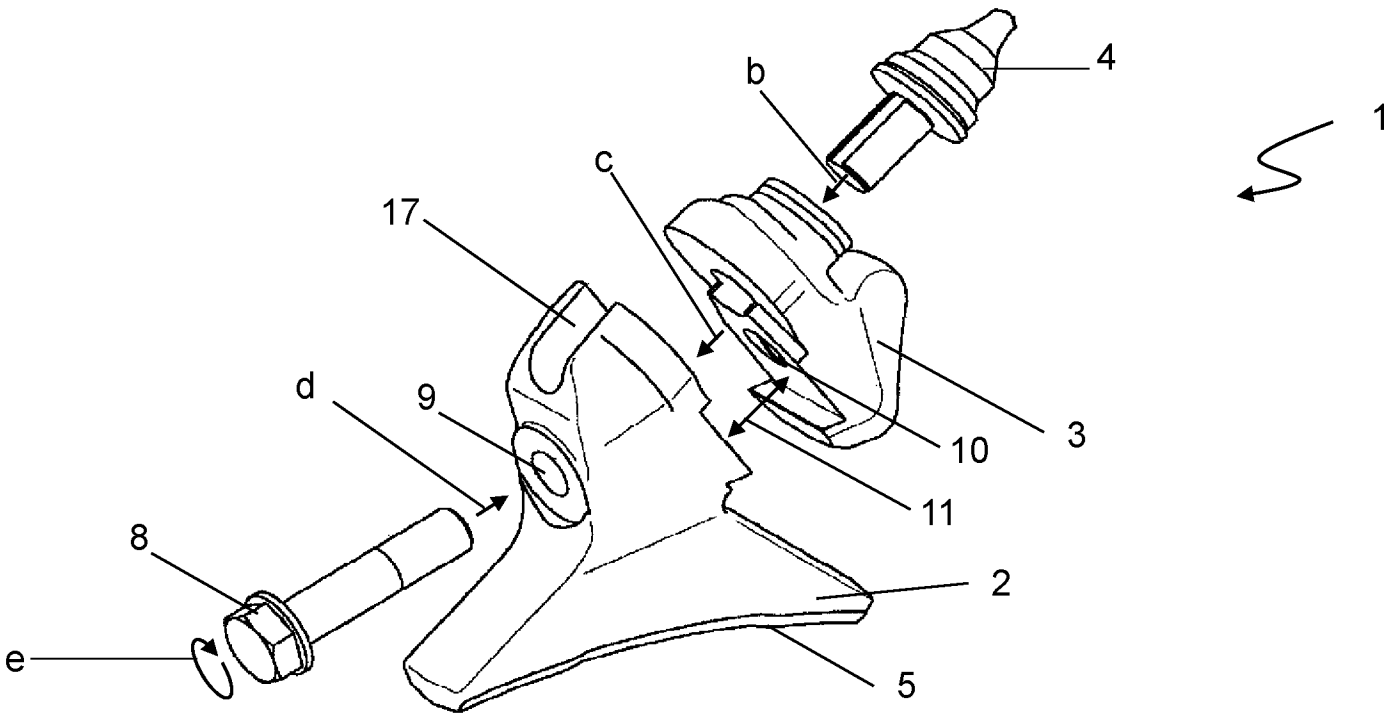
FIG. 4 is an exploded oblique view of the interchangeable holder system as shown in FIGS. 1 to 3, as viewed at the same angle as in FIG. 2.
Figure 7:
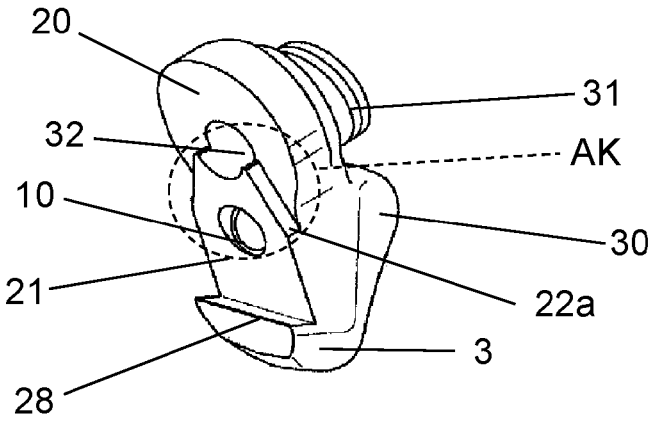
FIG. 7 is a perspective rearward view of the interchangeable holder as shown in FIGS. 1 to 4.
Figure 8:
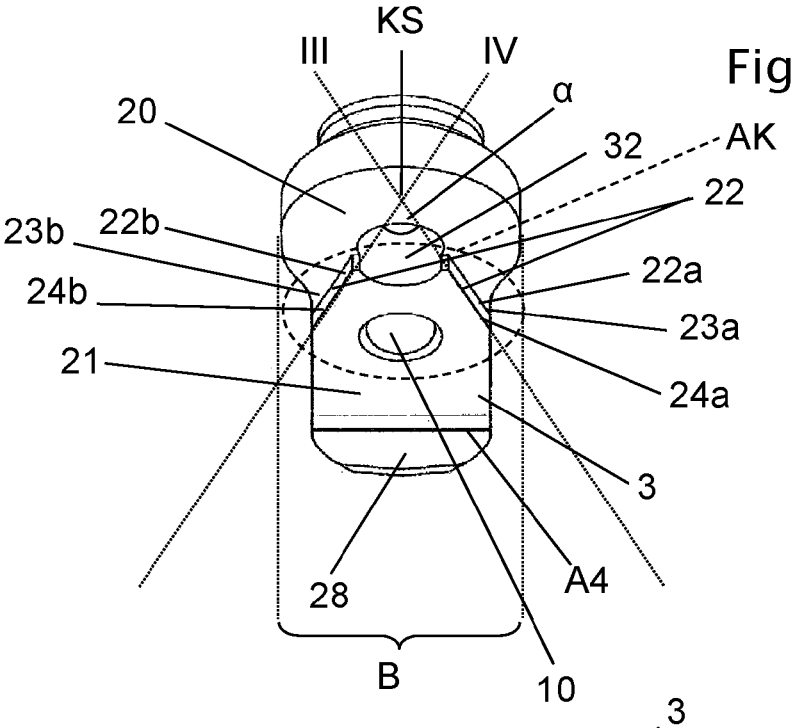
FIG. 8 is a perspective rearward view of the interchangeable holder as shown in FIG. 6.

FIG. 1 shows an interchangeable holder system 1 in the mounted state. FIGS. 2 to 4 illustrate alternative views of the interchangeable holder system 1 as shown in FIG. 1, while the following FIGS. 5 to 9 show individual views or enlarged details of this embodiment. In FIGS. 10 to 13 there are shown alternative design variants in detail.

Figure 13:
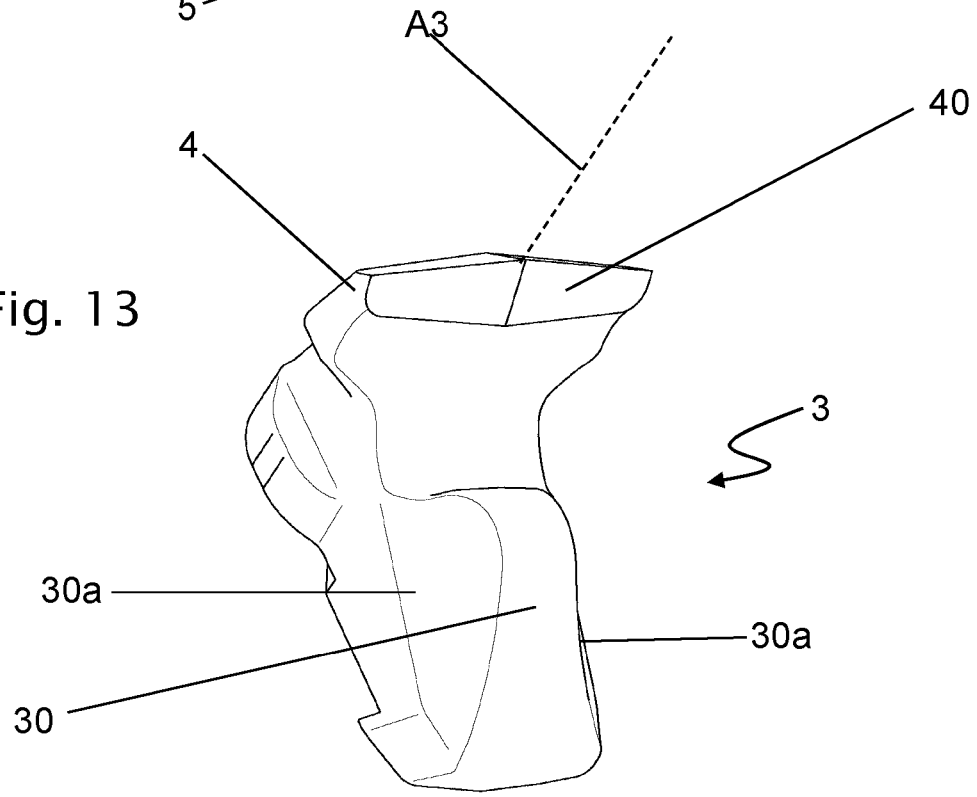
FIG. 13 shows a further embodiment of an interchangeable holder comprising an integrated cutting tool.

The basic structure of the interchangeable holder system will first be described in greater detail in an overview of FIGS. 1 to 4. The elements of the interchangeable holder system 1 according to one embodiment are a basic module 2, an interchangeable holder 3 located in the forward region of the basic module 2 and comprising a cutting tool 4. The basic module 2 has a bottom region 5, by means of which it is attached to a working drum 6 (only partially visible in FIG. 3) of a milling rotor (not completely visible in the figures). The interchangeable holder system 1 can be assembled by first of all attaching the basic module 2 via its bottom region 5 to the external surface of the working drum 6, for example by welding. In the present exemplary embodiment, the external surface of the working drum 6 is cylindrical in shape, but it is also basically possible to use a non-cylindrical drum body. The interchangeable holder 3 can be mounted on the basic module 2 in the manner described below in detail. The interchangeable holder 3 finally comprises the cutting tool 4, which may, on the one hand, be an independent component located on the interchangeable holder 3, and is more specifically, for example, a round shaft chisel, as shown in FIGS. 1 to 4. On the other hand, however, the cutting tool may alternatively be integrally united with the interchangeable holder 3, as illustrated, for example, by the exemplary embodiment of the interchangeable holder 3 shown in FIG. 13. The cutting tool 4 shown in FIG. 13 is more specifically a cutter 40 formed on the interchangeable holder. The longitudinal axis A3 of these embodiments is defined more particularly by a\perpendicular extending from the cutting edge to the contact surface between the interchangeable holder and the basic module. Under working conditions, the working drum 6 is caused to rotate by a suitable driving system, such that the cutting tool 4 comes into contact with the surface of the ground to be prepared in the machine direction "a", which it then mills, mixes, and crunches, etc., in an appropriate manner.

Another important element of the interchangeable holder system 1, is a securing device 7 comprising, in the present embodiment, a screw-threaded bolt 8, a through hole 9 in the basic module 2, and an insertion bore 10 having a female thread in the interchangeable holder 3. In FIGS. 1 and 2 this is indicated only by the head of the screw-threaded bolt 8 of the securing device 7 being visible in the form of a hexagon head, by way of example. Of course, a plurality of bolted joints and/or other alternative fastening mechanisms may be employed. The significance of the design of the securing device 7 resides in the fact that it makes it possible to fix the interchangeable holder 3 in its position on the basic module 2 as attached thereto. The individual assembly steps for the interchangeable holder system 1 are indicated, for example, in FIG. 4, in which the order of assembly of the individual elements of the interchangeable holder system 1 is first of all indicated by the arrows b, c and d. In order to finally fix the interchangeable holder 3 to the basic module 2, the screw-threaded bolt 8 engaging the female thread of the insertion bore 10 must be tightened in the direction of the arrow e.

One feature of the interchangeable holder system 1 resides in its comparatively narrow design as compared with its axial width B (width of the interchangeable holder system in the direction of the rotation axis of the working drum 6) which is made possible by the specific design of the connecting region between the basic module 2 and the interchangeable holder 3. Details on the structure of this connecting region are illustrated with regard to the basic module 2 especially in FIGS. 5 and 6, and with regard to the interchangeable holder 3 especially in FIGS. 7 and 8. The fundamental aspect of the present invention resides in the fact that for the purpose of mounting the interchangeable holder 3 on the basic module 2, it is laid flat on the basic module, is positionally stabilized by the wedge-shaped stopping step, and is then fixed in position by means of the securing device 7. For this purpose, the contact region or bearing region 11 between the basic module 2 and the interchangeable holder 3 is formed in the manner described below.

According to one embodiment, elements of the contact area 11 on the basic module 2 are a forward contact surface 12, a rearward contact surface 13 and the stopping step 14 in the form of a stop wedge AK (in the dashed circle). The terms "forward" and "rearward" refer to the relative positions of the contact surfaces 12 and 13 in relation to a reference perpendicular S standing on said contact surfaces 12 and 13 respectively in the region of the stopping step. The rearward contact surface 13 is thus at a receded level relative to the forward contact surface 12, as regarded in the direction towards the basic module 1. Under working conditions, the force applied to the interchangeable holder system 1 as a result of the resistance of the ground material being prepared acts in the direction $F_a$. While the drum is rotated, this force acts, with regard to the cutting periphery SK of the interchangeable holder system 1, tangentially against the region of the tip of the cutting tool 4 and can, with reference to the exemplary embodiment illustrated in FIGS. 1 to 4, be divided into an axial force $F_x$ effective in the axial direction A3 of the chisel shaft and a transverse force $F_q$ acting on the cutting tool 4 at right angles thereto in the plane of rotation of the milling rotor. The transverse forces $F_q$ act in a direction parallel to the forward contact surface and the rearward contact surface. Specifically, the cutting periphery SK is the cutting line or processing line along which the cutting tool 4 will pass when the drum is rotated. With reference to the specific embodiment shown in FIGS. 1 to 8, the terms "forward" and "rearward" also refer to the axial direction or longitudinal axis A3 of the chisel 4, as regarded in the direction towards the tip of the chisel. Thus the "forward" contact surface 12 is situated ahead of the rearward contact surface 13 as regarded in the direction towards the tip of the chisel. The contact surfaces 12, and 13 are in each case of a plane configuration and extend in each case to the marginal regions of the basic module 2. The contact surfaces 12 and 13 thus form the termination of the basic module 2 as regarded in the direction of the interchangeable holder 3. The contact surface 12 lies in the plane 15 and the contact surface 13 in the plane 16. The two planes 15 and 16 are parallel to each other and are spaced from each other by the distance ΔH along the perpendicular S (and in the present exemplary embodiment also along the longitudinal axis A3 of the cutting tool, more specifically the round shaft chisel 4). Alternatively, the planes 15 and 16 of the contact surfaces 12 and 13 may also be at an angle to each other and not parallel to each other. It is important the two planes 15 and 6 be at an angle to the perpendicular S or to the for longitudinal axis A3 of the chisel 4, at least in the region of the stopping step 14. It is also important that the forward contact surface 12 be disposed above the lower contact surface 13 on the basic module 2 with respect to a radial plane A5 (and vice versa on the interchangeable holder 3). The radial plane A5 relates to the rotation axis of the milling rotor or to a perpendicular standing on the external surface of the milling rotor. Thus the forward contact surface 12 is further removed from the milling drum or from the bottom region 5 of the basic module 2 than the lower contact surface 13, such that the interchangeable holder, as described in greater detail below, will be pressed into the basic module 2 and not pushed away therefrom under working conditions. Furthermore, the forward contact surface 12 is segmented and comprises two surface segments 12*a* and 12*b*, which, though spatially separated from each other by the opening 17 in the basic module 2, both still lie in the plane 15. However, the contact surface 13 is in the form of a continuous surface in the plane 16.

The two contact surfaces 12 and 13 are interconnected via the stopping step 14. Thus the stopping step 14 comprises the area of the contact region of the basic module 2 relative to the interchangeable holder 3, which is situated between the contact surface 12 or the surface segments 12*a* and 12*b* and the contact surface 13. The transition between the stopping step 14 and the rearward contact surface 13 is formed by the side edges 18*a* and 18*b* of the stopping step 14 and the transition relative to the forward contact surface 12 is formed by the side edges 19*a* and 19*b* (FIG. 6). The stopping step 14 is thus likewise segmented and comprises the two walls in the form of a steps or surface segments 14*a* and 14*b* (also referred to below as wedge flanks or stepped segments. Each of the two surface segments 14*a* and 14*b* is likewise planar and lies independently in a plane, the two planes of the surface segments 14*a* and 14*b* intersecting in the plane 15 of the forward contact surface and in the plane 16 of the rearward contact surface at a wedge angle α, as illustrated in detail in FIG. 6 by the extensions of the side edge 19*a* and the extension U of the side edge 19*b*. The two surface segments 14*a* and 14*b* of the stopping step 14 are thus, in this exe embodiment, configured as a "V" relatively to each other and together form a wedge-shaped receiver or a thrust wedge, as illustrated in detail by the extensions I and II of the two side edges 19*a* and 19*b* in FIG. 6. This wedge pointing away from the bottom region 5 of the basic module 2 serves to secure the position of the interchangeable holder 3 in the manner described below. The tip of the wedge formed by the two surface segments 14*a* and 14*b* is replaced by the opening 17. Instead of a flat design of the surface segments 14*a* and 14*b* it is also possible to form these regions as profiled or curved regions or regions provided with other surface segments, etc.

Figure 9:
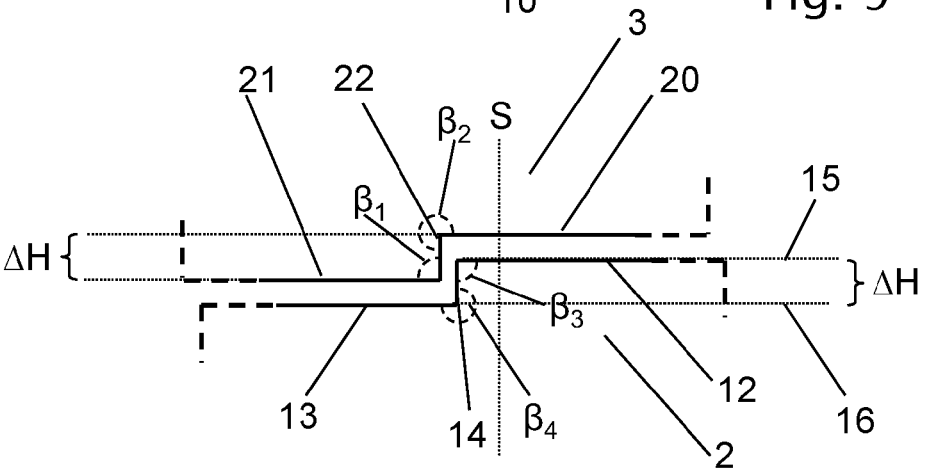
FIG. 9 is an enlarged detail of the region of contact between the interchangeable holder and the basic module.

The regions of the interchangeable holder 3 that are opposed to its forward contact surface 12 and its rearward contact surface 13 respectively beyond the stopping step 14 are configured for flat contact with the basic module and have structure that is complementary to the basic module 2 in this region. In addition, the interchangeable holder 3 is thus provided with two contact surfaces 2 and 21 facing the region of contact of the basic module 2, the contact surface 20 being situated at a receded level relative to the contact surface 21 in relation to the main body of the interchangeable holder 3. The plane of the contact surface 20 and the plane of the contact surface 21 are parallel to each other and are likewise spaced by a distance ΔH, relative to a perpendicular standing on one of the two planes (FIG. 9). Alternatively, the contact surfaces 20 and 21 may be non-parallel, i.e., at an angle to each other. The decisive requisite is that the contact surfaces 20 and 21 of the interchangeable holder 3 can, in the mounted state of the interchangeable holder system 1, rest against the contact surfaces 12 and 13 of the basic module 2. Both contact surface 20 and 21 are in the form of continuous surfaces, but it is basically equally possible for the region of contact of the interchangeable holder 3 to include segmented contact surfaces. As in the case of the basic module 2, the two contact surfaces 20 and 21 of the interchangeable holder 3 are also interconnected via a wedge-shaped stopping step 22, the stopping step being multipartite or segmented and comprising the two surface segments 22*a* and 22*b* (also referred to below as wedge flanks). The transition between the rearward contact surface 20 and the stopping step 22 is formed by the side edge 23 (comprising the segments 23*a* and 23*b*) and the transition between the stopping step 22 and the forward contact surface 21 is formed by the side edge 24 (comprising the segments 24*a* and 24*b*). In addition, the surface segments 22*a* and 22*b* of the stopping step 22 are at an angle α to each other (indicated in FIG. 8 by the extensions UI and IV of the side edges 24*a* and 24*b*), such that the stopping step 22 is configured as a whole to the effect that it forms a V-shaped wedge projecting towards the basic module 2 (but in the present embodiment forming a wedge-like protrusion in contrast to the wedged-shaped recess in the basic module 2) having wedge flanks 22*a* and 22*b*. In this respect, the (receiving) wedge formed on the basic module 2 is complementary, more particularly as regards height and angler position of the two stepped segments 14*a* and 14*b*, to the (projecting) wedge formed on the interchangeable holder 3 by the step-shaped segments 22*a* and 22*b*.

Figure 10:
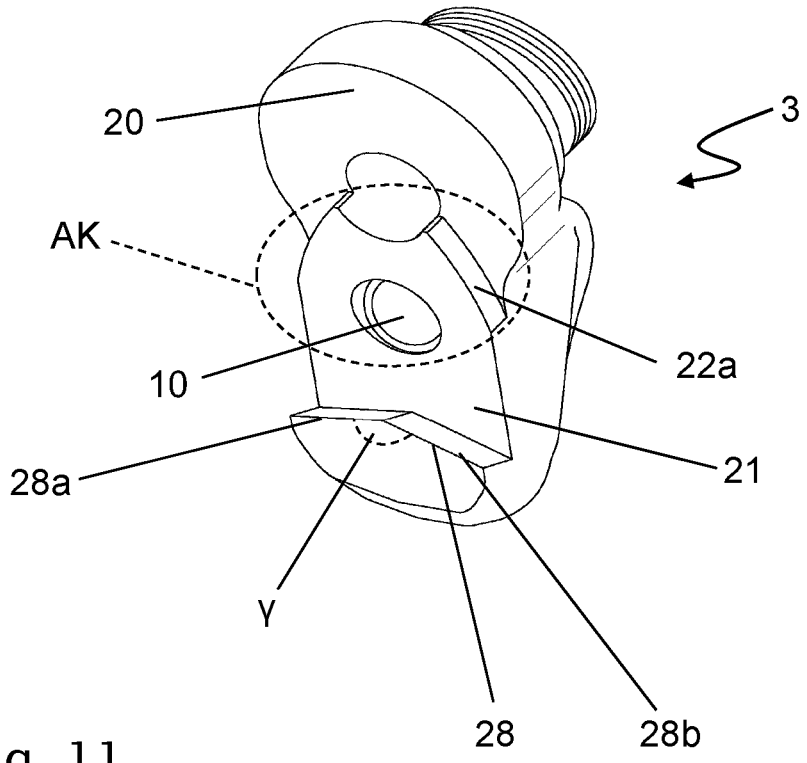
FIG. 10 is an alternative embodiment of the interchangeable holder comprising a convex stop wedge and a wedge-shaped relief ledge.
Figure 11:
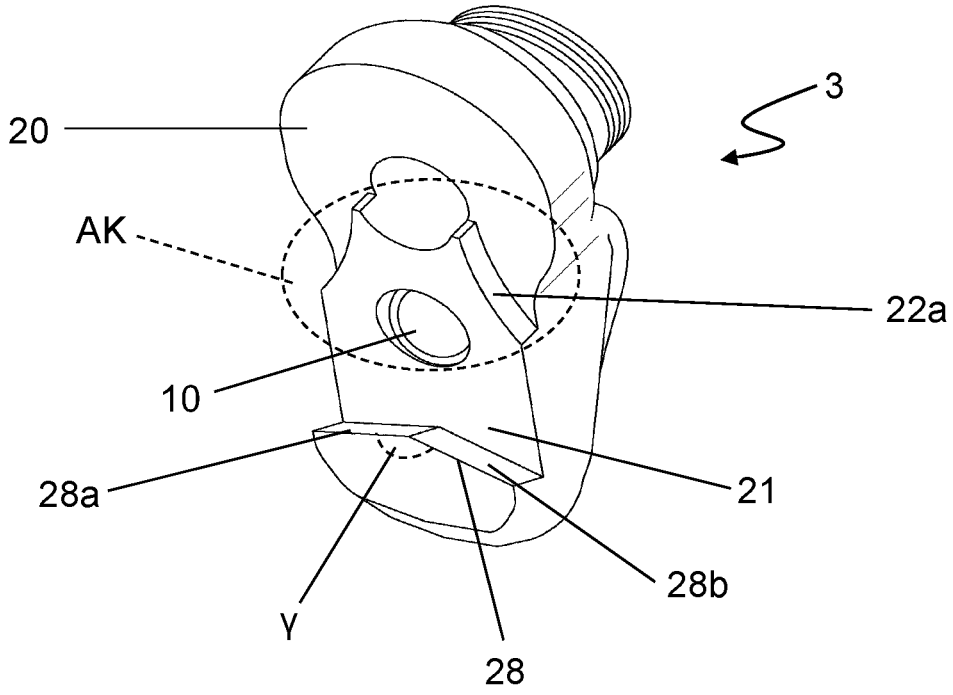
FIG. 11 shows a further alternative embodiment of the interchangeable holder comprising a concave stop wedge and a wedge-shaped relief ledge.
Figure 12:
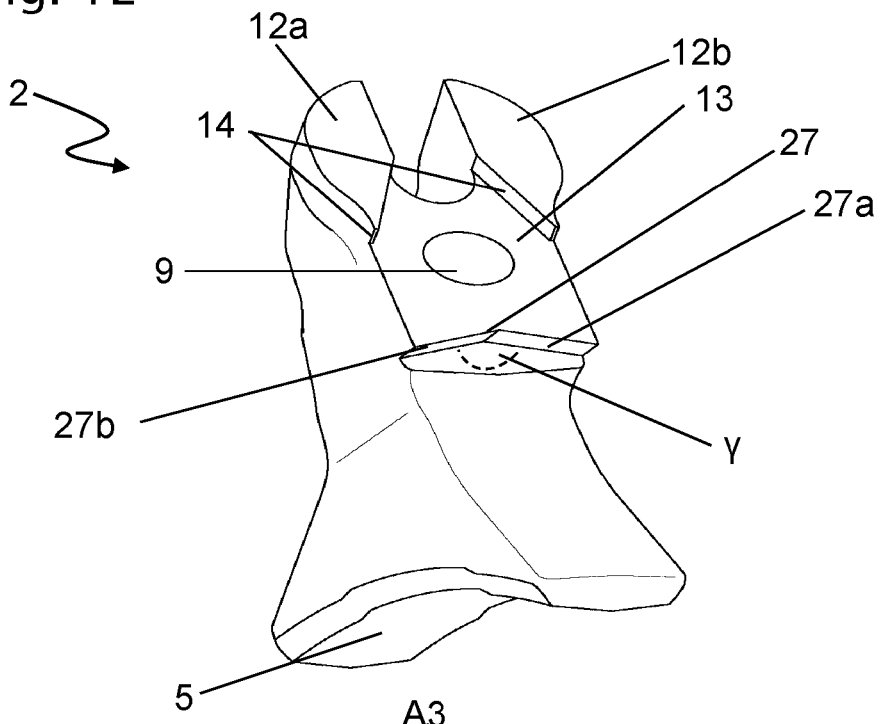
FIG. 12 shows a further embodiment of the basic module comprising a wedge-shaped supporting projection.

It is essential according to one aspect for the stop wedge AK of the present embodiments that the distance between the two opposing wedge flanks 22*a* and 22*b* (or the wedge flanks 14*a* and 14*b* on the basic module 2 configured to be complementary to said wedge flanks), to be at least partially broadened away from the tip of the wedge KS (indicated, for example, in FIGS. 6 and 9 as dashed extensions of the side edges 19*a*/19*b* and/or 24*a*/24*b*). In addition to the design of the stop wedge AK having plane flanks, as shown, for example in FIGS. 5 to 8, alternative designs of the stop wedge AK are possible. FIGS. 10 and 11 show in each case a stop wedge AK in the interchangeable holder 3 having, for example, curved wedge flanks 22*a* and 22*b*. For example, the two wedge flanks 22*a* and 22*b* in the exemplary embodiment as shown in FIG. 10 are curved towards each other towards the tip of the wedge (convex variant) and in the exemplary embodiment as shown in FIG. 11 are curved away from each other towards the tip of the wedge (concave variant). It is obvious that in these embodiments the interchangeable holder 3 of the appropriate basic module (not visible in the figures) must be complementary thereto or provided with a suitably curved stop wedge.

The adaptation of the region of contact on the basic module 2 to the design of the region of contact on the interchangeable holder 3 is further revealed by the enlarged detail shown in FIG. 9, which shows a portion of a side view of the interchangeable holder system 1 as shown in FIGS. 1 and 2, wherein the angle of view in FIG. 1 is indicated by the arrow f. The vertical misalignment ΔH between the forward contact surface 12 and the rearward contact surface 13 on the basic module 2 corresponds to the vertical misalignment ΔH present between the forward contact surface 21 and the rearward contact surface 20 on the interchangeable holder 3. Moreover, the planes 15 and 16 on the basic module 2 and the plane in which the rearward contact surface 20 and the forward contact surface 21 of the interchangeable holder 3 each lie are all parallel to each other. Alternatively, the non-superposed contact surfaces may be non-parallel to each other, i.e., at an angle to each other, in the mounted state. Thus the design of the basic module 2 in the region illustrated in FIG. 9 on an enlarged scale, taken from the region of contact, is a negative impression of the region of contact of the interchangeable holder 3, based on the design of the surfaces bearing against each other, and vice versa. When the interchangeable holder 3 is mounted on the basic module 2 in its holding position (for example as shown in FIGS. 1 to 3), the forward contact surface 2 of the basic module 2 will bear flat against the rearward contact surface 20 of the interchangeable holder 3, the rearward contact surface 13 of the basic module 2 will bear against the forward contact surface 21 of the interchangeable hold 3, and the stopping step 14 will bear against the stopping step 22, such that there is a continued positive fit between the basic module 2 and the interchangeable holder 3 across this entire region of contact.

More particularly, FIG. 9 further illustrates the angular position of the rearward contact surface 13 and the forward contact surface 12 relative to the stopping step 14 in the basic module 2 and the rearward contact surface 20 and the forward contact surface 21 relative to the stopping step 22 in the interchangeable holder 3, which, in the present exemplary embodiment, in each case is formed by a right angle or is equal, in the respective component, to 90° ($\beta_1$ and $\beta_3$) and/or 270° ($\beta_2$ and $\beta_4$). It is however also possible to vary this angle, in order, for example, to acquire an inclined position of the stopping step or of the individual segments of the respective stopping step, such that the interchangeable holder will, for example by means of its stopping step 22, which in the present exemplary embodiment is in the form of a wedge-like protrusion, partially engage the wedge receiving means of the stopping step 14 of the basic module 2 from behind, which wedge receiving means is likewise inclined in a complementary manner. For this purpose it is basically also possible for the contact surfaces 12 and 13 on the basic module 2 or the contact surfaces 20 and 21 on the interchangeable holder 3 to be non-parallel.

Another variant, which is not illustrated in the present figures, consists in disposing the wedge-like protrusion on the basic module 2 and the wedge receiving means on the interchangeable holder 3 or in swapping the regions of contact between the interchangeable holder 3 and the basic module 2 as shown in the figures. The essential prerequisite is that the basic module 2 and the interchangeable holder 3 together form a wedge-type bearing having the stated properties.

The design of the contact surfaces 12, 13, 20, and 21 and of the stopping steps 14 and 22 makes it possible for the interchangeable holder 3 to bear flat against the basic module 2. For the purpose of fixing the interchangeable holder 3 to the basic module 2, there is provided a securing device 7, which makes it possible to finally tighten the interchangeable holder 3 against the basic module 2. To this end, the longitudinal axis A1 of the screw-threaded bolt 8 extends in the longitudinal cross-sectional plane as shown in FIG. 3 obliquely to the reference perpendicular S and obliquely to the longitudinal axis A3 or rotation axis of the round shaft chisel (=cutting tool 4) bearing-mounted in the insertion bore 32 in the interchangeable holder 3 (A3 is, in the present exemplary embodiment, parallel to the reference perpendicular S, or the rotation axis/longitudinal axis A3 is likewise at right angles to the forward contact surface and the rearward contact surface 12, 13, 20, and 21 between the basic module 2 and the interchangeable holder 3). By this means the interchangeable holder 3 will, during its assembly on the basic module 2 and during tightening of the screw-threaded bolt 8, be drawn into the wedge-shaped stopping step or drawn via its own stop wedge AK into the complementary stop wedge AK on the basic module 2 until it bears against the stop limit surfaces 12 and 13 and against the stopping step 14, by which means the assembly, in particular, is facilitated and a positive interlock is obtained. Another essential feature is that the female thread engaged by the screw-threaded bolt 8 in the interchangeable holder 3 is disposed in the interchangeable holder 3. With each replacement of the interchangeable holder 3 there is at the same time a renewal of a part of the securing device 7 in the interchangeable holder system 1, more specifically the female thread, so that perfect functioning of the screw-threaded bolt 8 is ensured.

Another essential feature of the interchangeable holder system 1 resides in the fact that the cutting tool 4 bearing-mounted in the interchangeable holder 3 of the mounted interchangeable holder system 1 can be accessed from the rear (as regarded along the longitudinal axis and the working tip of the round shaft chisel) by an ejecting tool 25 (purely phantomly illustrated in FIG. 3) and can be pressed forwardly out of the insertion bore 32 of the interchangeable holder 3. Said access is made possible, on the one hand, by means of an insertion bore 32 for the cutting tool extending through the interchangeable holder 3 and, on the other hand, by means of the generously dimensioned opening 17, with regard to its spatial dimensions, on the basic module 2, which opening 17 leads towards the interchangeable holder 3 to merge with the insertion bore for the cutting tool in the interchangeable holder 3.

On account of the presence of the stopping steps 14 and 22 bearing against each other in the basic module 2 and in the interchangeable holder 3 respectively, an anti-twist lock is achieved between the interchangeable holder 3 and the basic module 2 and thus likewise between the interchangeable holder 3 and the working drum 6 supporting the interchangeable holder system 1. This positive effect is greatly enhanced by the fact that the stopping steps 14 and 22 are in each case in the form of wedges, such that the two wedge-shaped elements, in the assembled state of the interchangeable holder system 1, interengage or bear against each other. By this means, not only is the anti-rotatory effect of the stopping steps 14 and 22 enhanced, but also at the same time the assurance of exact positioning of the interchangeable holder 3 with respect to the basic module 2 is improved.

Another essential feature of the exemplary embodiment illustrated in the figures is the presence of a relieving or supporting device 29, comprising a supporting projection 27 on the basic module 2 and a base ledge 28 on the interchangeable holder 3. The supporting device 29 makes it possible to achieve a reduction of the load on the interchangeable holder 3, and more particularly on the securing device 7, when the interchangeable holder system 1 is heavily loaded, i.e., to achieve overload protection. The supporting device is to this end configured such that the interchangeable holder 3, when heavily loaded, comes to bear, with its base ledge 28, flat against the supporting projection 27 on the basic module 2, by which means additional force absorption is rendered possible over the region of the supporting device 29. For this purpose, the supporting projection 27 and the base ledge 28 have supporting surfaces facing each other, which in the loaded condition come to bear against each other. In the less loaded mounted state of the interchangeable holder system 1, there is, in the present exemplary embodiment, thus a narrow gap between these supporting surfaces. The hook-like shaped base ledge 28 engages, for this purpose, in the undercut formed by the supporting projection 27. The contact surface on the supporting projection 27 extends in the cross-section of the interchangeable holder 3 (FIG. 3) along the axis A2, which more particularly extends obliquely to the direction of action of the applied force $F_a$ and obliquely to the axis A1. The essential point of this arrangement is, furthermore, that the supporting device 29 of the interchangeable holder 3 is additionally stabilized in its assembled position with respect to the basic module 2 when heavily loaded and at the same time relieves the securing device 7 (more specifically the mounting screw 8). The supporting device 29 is further configured such that the interchangeable holder 3 is drawn up via its base ledge 28 against the underside of the supporting projection 27 when the screw-threaded bolt 8 is tightened.

The supporting projection 27 extends with its contact surface along the axis A4 (FIG. 5) linearly across the entire width B of the basic module 2 and merges via a linear edge 33 into the rearward contact surface 13. The axis A4 thus lies in the plane 16. In the region in which the base ledge 28 bears against the supporting projection 27, it is configured in a complementary manner and comprises two plane surfaces disposed at an angle to each other. It is, however, also possible to configure the stop limit surfaces of the supporting device 29 with a profile. Thus it has proved to be advantageous when, for example, the contact surface of the supporting device 29 is provided with a profile in the form of a roof or wedge such as the surfaces 27*a* and 27*b* and/or 28*a* and 28*b* disposed at an angle γ relative to each other, as shown, for example, in FIGS. 10 and 11 for the interchangeable holder 3 and in FIG. 12 for the basic module 2, to give an improved torque support. The tip of the wedge points in the direction of the stop wedge AK. Of course, alternative designs of the stopping region may be provided, as for example a plurality of roof-shaped profiles and/or a plurality of supporting devices 29 between the basic module 2 and the interchangeable holder 3, etc.

The interchangeable holder 3 finally also comprises an attrition bulge protruding in the machine direction "a", i.e., a domed attrition region 30 having two material guiding surfaces 30*a* and 30*b* sloping to the side and to the rear. The camber of the attrition region 30 extends from the interchangeable holder 3 parallel to the longitudinal axis A3 of the chisel 4 to across the plane in which a wearing disk VS is disposed between the chisel 4 and the region of contact of the chisel 4 in the axial direction A3 on the interchangeable holder 3. This plane is at right angles to the cutting plane in FIG. 3. The interchangeable holder 3 in its entirety together with the attrition region 30 covers the region of contact with the basic module 2 and more particularly protects the basic module 2 from attrition. Basically, this effect of the interchangeable holder 3 may be enhanced when the basic module 2 has an overlapping configuration. Directly below the round shaft chisel 4 annularly overlapping the interchangeable holder 3 in the axial direction A3, there is present another attrition region 31 on the interchangeable holder 3, on which the wearing disk VS rests.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. An interchangeable holder system comprising, comprising:

a basic module and an interchangeable holder configured to be attached to said basic module and equipped with a cutting tool, wherein said basic module comprises a forward contact surface and a rearward contact surface situated at a receded level relative to said forward contact surface with reference to a longitudinal axis of said cutting tool, said forward contact surface and said rearward contact surface being separated from each other by a stopping step in the form of a stop wedge having at least two wedge flanks that approach one another at a wedge angle $\alpha$, said forward contact surface extending, with reference to a bottom region of said basic module, at least partially above said rearward contact surface such that said interchangeable holder, in the case of a work load on said cutting tool, is pressed against said stopping step, and wherein said interchangeable holder is configured for at least partial continuous contact with said forward contact surface and said rearward contact surface across said stopping step, and at least one securing device to secure the interchangeable holder in a fixed position on said basic module.

2. The interchangeable holder system as defined in claim 1, wherein said interchangeable holder is configured so as to be complementary to said forward contact surface, to said rearward contact surface, and to said stopping step of said basic module.

3. The interchangeable holder system as defined in claim 1, wherein said forward and said rearward contact surfaces lie in respective planes.

4. The interchangeable holder system as defined in claim 1, wherein said forward contact surface and said rearward contact surface lie in respective planes that are parallel to each other.

5. The interchangeable holder system as defined in claim 1, wherein said stopping step comprises a pair of edges that are each linear.

6. The interchangeable holder system as defined in claim 1, wherein said stopping step comprises a pair of edges that are each curved.

7. The interchangeable holder system as defined in claim 1, wherein said stopping step is segmented.

8. The interchangeable holder system as defined in claim 1, wherein said stop wedge comprises two segments, which form a "V" relatively to each other.

9. The interchangeable holder system as defined in claim 8, wherein longitudinal edges of said two segments lie in respective planes at right angles to a direction of travel of the cutting tool and are at an angle to each other in a range of from 120° to 30 °.

10. The interchangeable holder system as defined in claim 8, wherein the two segments of the stop wedge are mirror-symmetrically disposed.

11. The interchangeable holder system as defined in claim 8, wherein longitudinal edges of said two segments lie in respective planes at right angles to a direction of travel of the cutting tool and are at an angle to each other in a range of from 100° to 50 °.

12. The interchangeable holder system as defined in claim 8, wherein longitudinal edges of said two segments lie in respective planes at right angles to a direction of travel of the cutting tool and are at an angle to each other in a range of from 80° to 60 °.

13. The interchangeable holder system as defined in claim 1, wherein a tip of the stop wedge points away from said bottom region of said basic module 2.

14. The interchangeable holder system as defined in claim 1, wherein a wall in the form of a step of the stopping step is at right angles to said forward contact surface and to said rearward contact surface.

15. The interchangeable holder system as defined in claim 1, wherein a relief ledge is provided on the interchangeable holder, and a supporting projection is provided on the basic module.

16. The interchangeable holder system as defined in claim 1, wherein said interchangeable holder comprises a toolhead for the accommodation of a replaceable cutting tool.

17. The interchangeable holder system as defined in claim 1, wherein said cutting tool is integrally united with said interchangeable holder.

18. The interchangeable holder system as defined in claim 1, wherein said interchangeable holder comprises a domed attrition region facing away from said basic module.

19. The interchangeable holder system as defined in claim 1, wherein an opening is provided on said basic module which is configured to allow access to said cutting tool in said interchangeable holder.

20. A construction machine for the preparation of ground surfaces, comprising a milling rotor on which at least one interchangeable holder system as defined in claim 1 is disposed.

21. The construction machine as defined in claim 20, wherein said construction machine comprises one of a cold milling machine, a stabilizer or a recycler.

* * * * *